US009410283B1

(12) United States Patent
Maronikolakis et al.

(10) Patent No.: US 9,410,283 B1
(45) Date of Patent: Aug. 9, 2016

(54) PORTABLE CLOTHES STEAMING ASSEMBLY

(76) Inventors: Haritos Maronikolakis, Staten Island, NY (US); Stamatis Maronikolakis, Staten Island, NY (US)

( * ) Notice: Subject to any disclaimer, the term of this patent is extended or adjusted under 35 U.S.C. 154(b) by 1079 days.

(21) Appl. No.: 13/534,100

(22) Filed: Jun. 27, 2012

(51) Int. Cl.

| | |
|---|---|
| ***D06F 87/00*** | (2006.01) |
| ***D06F 71/34*** | (2006.01) |
| ***D06F 75/20*** | (2006.01) |
| ***F22B 1/28*** | (2006.01) |
| ***D06B 19/00*** | (2006.01) |

(52) U.S. Cl.
CPC ..... *D06F 87/00* (2013.01); *D06B 19/0029* (2013.01); *D06F 71/34* (2013.01); *D06F 75/20* (2013.01); *F22B 1/28* (2013.01); *F22B 1/284* (2013.01)

(58) Field of Classification Search
CPC ..... D06F 87/00; D06F 71/34; D06F 75/14; D06F 75/16; D06F 75/18; D06F 75/20; A45D 20/10; F22B 1/30; F22B 1/282; F22B 1/284; D06B 19/0029
See application file for complete search history.

(56) References Cited

U.S. PATENT DOCUMENTS

| | | | | |
|---|---|---|---|---|
| 3,620,055 | A | 11/1971 | Blachly et al. | |
| 3,646,317 | A | 2/1972 | Osrow | |
| 3,654,780 | A | 4/1972 | Frank | |
| 3,742,629 | A | 7/1973 | Plasko | |
| 4,401,102 | A | 8/1983 | Bovino et al. | |
| 5,526,829 | A | 6/1996 | Smith | |
| 6,622,404 | B2 * | 9/2003 | Valiyambath | D06F 75/02 38/77.8 |
| D481,183 | S | 10/2003 | Mangano | |
| 6,986,217 | B2 * | 1/2006 | Leung | D06F 73/00 38/77.83 |
| 7,155,117 | B2 | 12/2006 | Leung et al. | |
| 7,578,025 | B2 * | 8/2009 | Kostreba | A46B 13/008 15/321 |
| 7,923,661 | B2 * | 4/2011 | Lee | D06F 75/00 219/245 |
| 8,131,137 | B1 * | 3/2012 | Cowles | A47J 36/2433 392/386 |
| 2007/0133962 | A1 * | 6/2007 | Rizzuto | A47L 1/08 392/324 |
| 2009/0313767 | A1 * | 12/2009 | Tanner | D06F 73/00 8/149.3 |
| 2010/0058623 | A1 * | 3/2010 | Fernandez | D06F 71/18 38/14 |
| 2010/0146826 | A1 * | 6/2010 | Lee | D06F 75/12 38/77.83 |
| 2012/0266502 | A1 * | 10/2012 | Noto | D06F 71/34 38/77.1 |

FOREIGN PATENT DOCUMENTS

WO WO9221306 A1 * 10/1992

* cited by examiner

*Primary Examiner* — Ismael Izaguirre

(57) ABSTRACT

A portable clothes steaming assembly for removing wrinkles from clothing after traveling includes a housing and a nozzle coupled to a front end of the housing. A tank is positioned in the housing to hold a liquid within the housing. The nozzle is in fluid communication with the tank. A heating element is positioned in the housing to heat the liquid in the tank whereby steam is expelled from the tank through the nozzle. An actuator is coupled to the housing and operationally coupled to the heating element for selectively heating the liquid. A power source is positioned in the housing and electrically coupled to the heating element.

10 Claims, 3 Drawing Sheets

PORTABLE CLOTHES STEAMING ASSEMBLY

BACKGROUND OF THE DISCLOSURE

Field of the Disclosure

The disclosure relates to steaming devices and more particularly pertains to a new steaming device for removing wrinkles from clothing after traveling.

SUMMARY OF THE DISCLOSURE

An embodiment of the disclosure meets the needs presented above by generally comprising a housing and a nozzle coupled to a front end of the housing. A tank is positioned in the housing to hold a liquid within the housing. The nozzle is in fluid communication with the tank. A heating element is positioned in the housing to heat the liquid in the tank whereby steam is expelled from the tank through the nozzle. An actuator is coupled to the housing and operationally coupled to the heating element for selectively heating the liquid. A power source is positioned in the housing and electrically coupled to the heating element.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
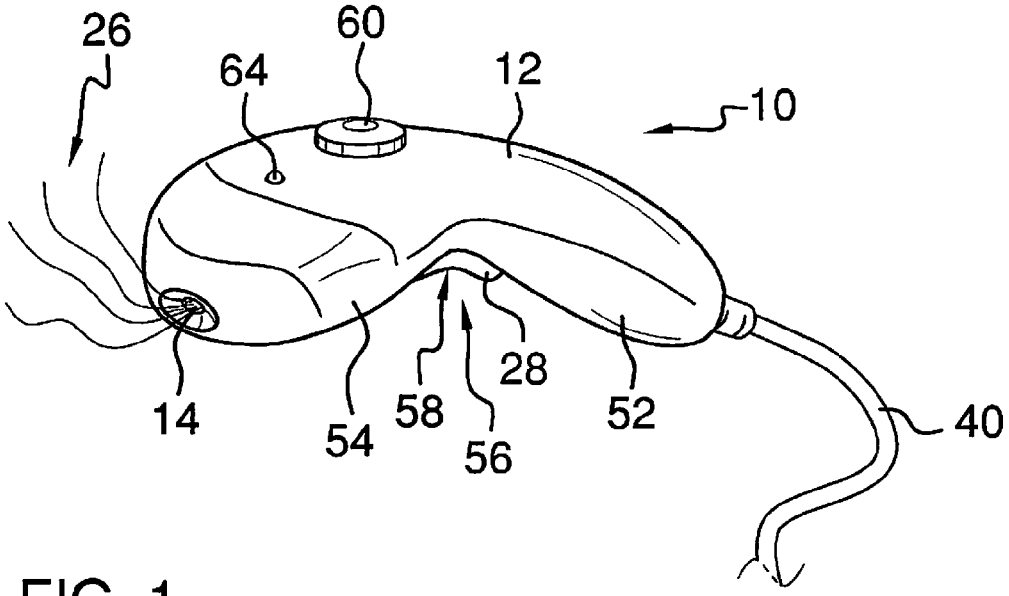
FIG. 1 is a top front side perspective view of a portable clothes steaming assembly according to an embodiment of the disclosure.
Figure 2:
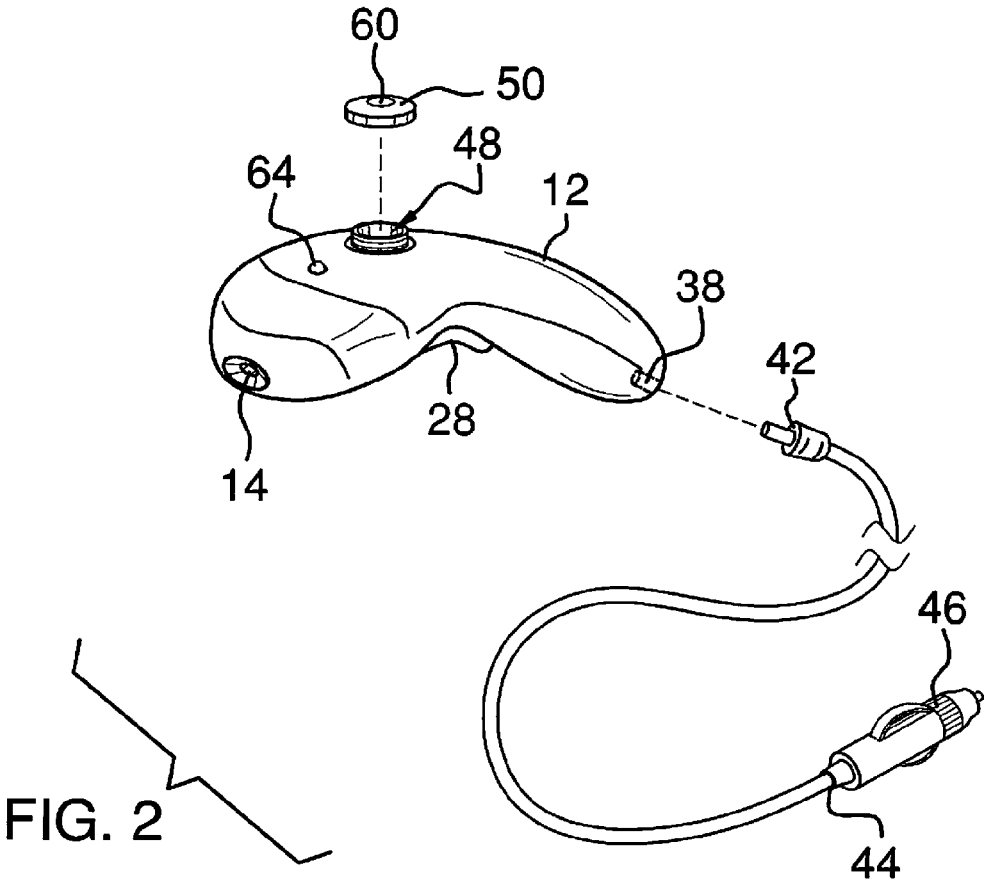
FIG. 2 is a partially exploded top front side perspective view of an embodiment of the disclosure.
Figure 3:
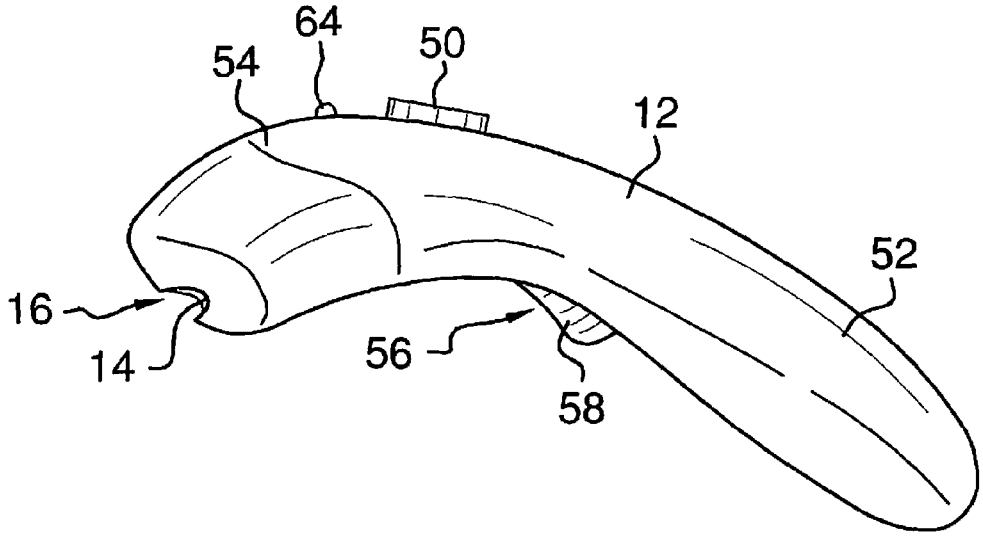
FIG. 3 is a side view of an embodiment of the disclosure.
Figure 4:
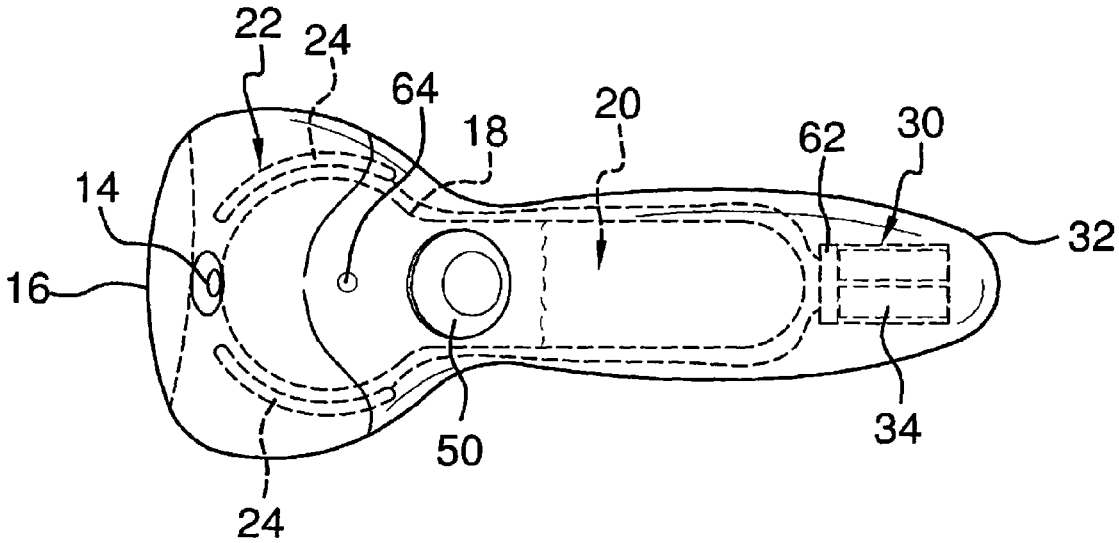
FIG. 4 is a top view of an embodiment of the disclosure.

With reference now to the drawings, and in particular to FIGS. 1 through 6 thereof, a new steaming device embodying the principles and concepts of an embodiment of the disclosure and generally designated by the reference numeral 10 will be described.

As best illustrated in FIGS. 1 through 6, the portable clothes steaming assembly 10 generally comprises a housing 12 and a nozzle 14 coupled to a front end 16 of the housing 12. A tank 18 is positioned in the housing 12. The nozzle 14 is in fluid communication with the tank 18. The tank 18 is configured for holding a liquid 20, typically distilled water, in the housing 12. A heating element 22 is positioned in the housing 12 and may include a pair of spaced arcuate rods 24 positioned around the tank 18 proximate to the front end 16 of the housing 12. The heating element 22 is positioned to heat the liquid 20 in the tank 18 whereby steam 26 is expelled from the tank 18 through the nozzle 14. An actuator 28 is coupled to the housing 12. The actuator 28 is operationally coupled to the heating element 22 for selectively heating the liquid 20.

A power source 30 is positioned in the housing 12 and may be proximate a rear end 32 of the housing 12. The power source 30 is electrically coupled to the heating element 22. The power source 30 may be a battery 34 and it may be rechargeable. A charging port 38 is coupled to the housing 12 at the rear end 32 of the housing 12. The charging port 38 is electrically coupled to the power source 30. A power cord 40 is provided having a first end 42 and a second end 44. The first end 42 is engageable to the charging port 38 whereby the power cord 40 provides power to charge the power source 38. A plug 46 is coupled to the second end 44 of the power cord 40. The plug 46 may be configured for electrical engagement to a vehicle power port or a wall socket.

A filling port 48 is coupled to the housing 12. The filling port 48 is in environmental communication with the tank 18 to facilitate placing liquid 20 into the tank 18. A cap 50 is selectively engageable to the housing 12 covering the filling port 48 whereby liquid 20 in the tank 18 is prevented from passing through the filling port 48.

Figure 5:
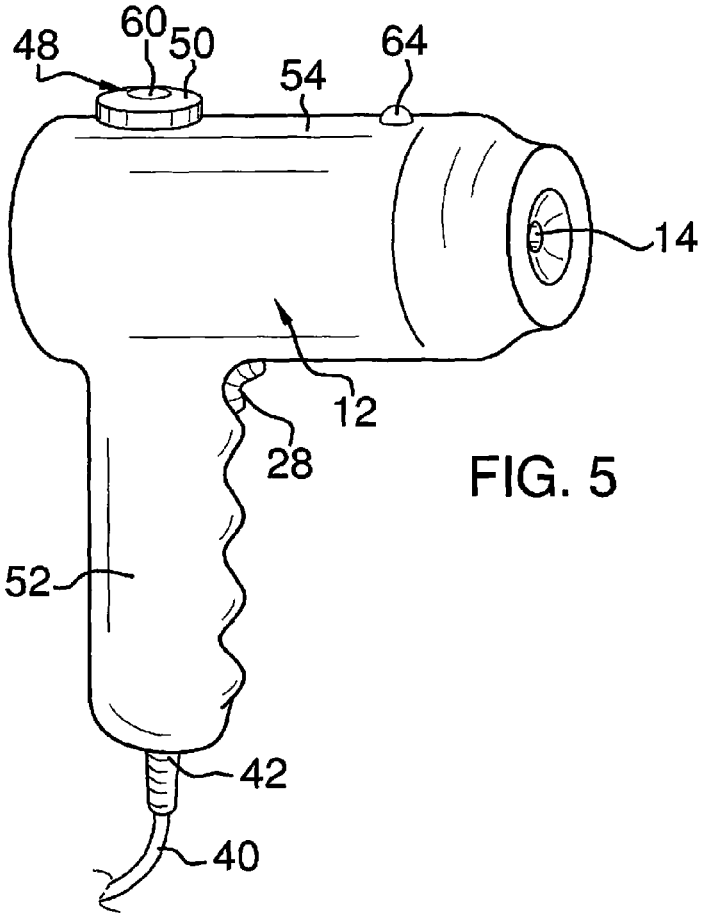
FIG. 5 is a top front side perspective view of an alternative embodiment of the disclosure.
Figure 6:
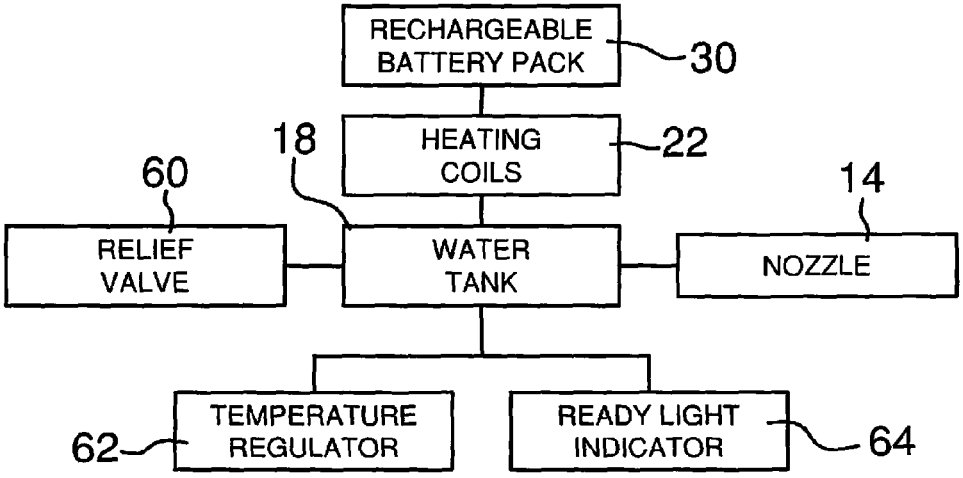
FIG. 6 is a schematic view of an embodiment of the disclosure.

A handle 52 is coupled to and extends from a main section 54 of the housing 12. The main section 54 may have an oblong shaped cross-section, as in FIGS. 1 through 4, or a cylindrical shape as shown in FIG. 5. The handle 52 may extend from the main section 54 of the housing 12 through a curvature forming an obtuse angle between the main section 54 and the handle 52. Alternatively, as shown in FIG. 5, the handle 52 may extend from the main section 54 adjacent to the rear end 32 of the housing 12 in a transverse orientation. The actuator 28 is positioned at a junction 56 between the handle 52 and the main section 54 of the housing 12 whereby the actuator forms a trigger 58 configured for being manipulated by a finger of a hand grasping the handle 52. The handle 52 may be integrally formed with the housing 12.

A relief valve 60 may be coupled to the housing 12. The relief valve 60 is in fluid communication with the tank 18 whereby the relief valve 60 vents pressure in the tank 18 in excess of a pre-determined threshold amount without expelling steam from the nozzle 14. A temperature regulator 62 may also be positioned in the housing 12 and operationally coupled to the heating element 22 for regulating a temperature of the heating element 22 whereby excessive temperature within the tank 18 is prevented. An indicator light 64 may be coupled to the housing 12. The indicator light 64 is operationally coupled to the tank 18 to measure temperature or pressure whereby the indicator light 64 is selectively illuminated or not illuminated to indicate a state of readiness for expelling steam 26 through the nozzle 14.

In use, the tank 18 is filled with liquid 20. When needed to remove wrinkles from clothing due to use of a seatbelt or other travel related situation, the handle 52 is grasped and the heating element 22 actuated to expel steam 26 through the nozzle 14. The steam 26 produced may be directed towards a wrinkled garment to release the wrinkles. The assembly 10 may be used without the power cord 46 if so desired or with the power cord 46 in the event the power source 46 is depleted.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A portable clothes steaming assembly comprising:

a housing;

a nozzle coupled to a front end of said housing;

a tank positioned in said housing, said nozzle being in fluid communication with said tank, said tank being configured for holding a liquid in said housing;

a heating element positioned in said housing, said heating element being positioned to heat the liquid in said tank whereby steam is expelled from said tank through said nozzle and forwardly from said housing;

an actuator coupled to said housing, said actuator being operationally coupled to said heating element for selectively heating the liquid;

a power source positioned in said housing, said power source being electrically coupled to said heating element, said power source being a rechargeable battery;

a charging port coupled to said housing, said charging port being electrically coupled to said power source;

a power cord having a first end and a second end, said first end being engageable to said charging port whereby said power cord provides power to charge said power source; and a plug coupled to said second end of said power cord, said plug being configured for electrical engagement to a vehicle power port.

2. The assembly of claim 1, further including a filling port coupled to said housing, said filling port being in environmental communication with said tank.

3. The assembly of claim 2, further including a cap, said cap being selectively engageable to said housing covering said filling port whereby liquid in said tank is prevented from passing through said filling port.

4. The assembly of claim 1, further including a handle coupled to and extending from a main section of said housing.

5. The assembly of claim 4, further including said handle being integrally formed with said housing.

6. The assembly of claim 4, further including said actuator being positioned at a junction between said handle and said main section of said housing whereby said actuator forms a trigger configured for being manipulated by a finger of a hand grasping said handle.

7. The assembly of claim 1, further including a relief valve coupled to said housing, said relief valve being in fluid communication with said tank whereby said relief valve vents pressure in said tank in excess of a pre-determined threshold amount.

8. The assembly of claim 1, further including a temperature regulator positioned in said housing, said temperature regulator being operationally coupled to said heating element for regulating a temperature of said heating element whereby excessive temperature within said tank is prevented.

9. The assembly of claim 1, further including an indicator light coupled to said housing, said indicator light being operationally coupled to said tank whereby said indicator light is illuminated to indicate a state of readiness for expelling steam through said nozzle.

10. A portable clothes steaming assembly comprising:

a housing;

a nozzle coupled to a front end of said housing;

a tank positioned in said housing, said nozzle being in fluid communication with said tank, said tank being configured for holding a liquid in said housing;

a heating element positioned in said housing, said heating element being positioned to heat the liquid in said tank whereby steam is expelled from said tank through said nozzle;

an actuator coupled to said housing, said actuator being operationally coupled to said heating element for selectively heating the liquid;

a power source positioned in said housing, said power source being electrically coupled to said heating element, said power source being a battery, said battery being rechargeable;

a charging port coupled to said housing, said charging port being electrically coupled to said power source;

a power cord having a first end and a second end, said first end being engageable to said charging port whereby said power cord provides power to charge said power source;

a plug coupled to said second end of said power cord, said plug being configured for electrical engagement to a vehicle power port;

a filling port coupled to said housing, said filling port being in environmental communication with said tank;

a cap, said cap being selectively engageable to said housing covering said filling port whereby liquid in said tank is prevented from passing through said filling port;

a handle coupled to and extending from a main section of said housing, said actuator being positioned at a junction between said handle and said main section of said housing whereby said actuator forms a trigger configured for being manipulated by a finger of a hand grasping said handle, said handle being integrally formed with said housing;

a relief valve coupled to said housing, said relief valve being in fluid communication with said tank whereby said relief valve vents pressure in said tank in excess of a pre-determined threshold amount;

a temperature regulator positioned in said housing, said temperature regulator being operationally coupled to said heating element for regulating a temperature of said heating element whereby excessive temperature within said tank is prevented; and an indicator light coupled to said housing, said indicator light being operationally coupled to said tank whereby said indicator light is illuminated to indicate a state of readiness for expelling steam through said nozzle.

* * * * *